US005297627A

United States Patent [19]

Sanchez et al.

[11] Patent Number: 5,297,627

[45] Date of Patent: Mar. 29, 1994

[54] METHOD FOR REDUCED WATER CONING IN A HORIZONTAL WELL DURING HEAVY OIL PRODUCTION

[75] Inventors: J. Michael Sanchez, Carrollton; Herbert G. Weinstein, Dallas, both of Tex.

[73] Assignee: Mobil Oil Corporation, Fairfax, Va.

[21] Appl. No.: 759,353

[22] Filed: Sep. 13, 1991

Related U.S. Application Data

[63] Continuation-in-part of Ser. No. 419,875, Oct. 11, 1989, abandoned, and a continuation-in-part of Ser. No. 625,289, Dec. 10, 1990, abandoned.

[51] Int. Cl.[5] ..... E21B 43/24

[52] U.S. Cl. ..... 166/272; 166/302; 166/50; 166/57; 166/64

[58] Field of Search ..... 166/268, 269, 302, 303, 166/305.1, 306, 50, 57, 64, 74, 272

[56] References Cited

U.S. PATENT DOCUMENTS

| | | | |
|---|---|---|---|
| 3,338,306 | 8/1967 | Cook | 166/50 X |
| 3,650,327 | 3/1972 | Burnside | 166/303 |
| 3,861,469 | 1/1975 | Bayless et al. | 166/303 |
| 3,994,340 | 11/1976 | Anderson et al. | 166/50 X |
| 4,024,919 | 5/1977 | Pujol | 166/303 |
| 4,085,803 | 4/1978 | Butler | 166/303 |
| 4,116,275 | 9/1978 | Butler et al. | 166/50 X |
| 4,276,936 | 7/1981 | McKinzie | 166/303 |
| 4,696,345 | 9/1987 | Hsueh | 166/50 X |
| 4,702,314 | 10/1987 | Huang et al. | 166/245 |

FOREIGN PATENT DOCUMENTS

| | | | |
|---|---|---|---|
| 782369 | 4/1968 | Canada | 166/50 |

*Primary Examiner*—Ramon S. Britts
*Assistant Examiner*—Roger J. Schoeppel
*Attorney, Agent, or Firm*—Alexander J. McKillop; Charles A. Malone; George W. Hager, Jr.

[57] ABSTRACT

A method to reduce water coning in viscous oil formations during primary oil production wherein a horizontal wellbore is heated by circulating steam therein thereby heating a radial area near the wellbore. Near wellbore heating alters a pressure profile in the radial area near the wellbore. Reduced inflow pressure gradients near the wellbore flatten out a pressure sink associated with the wellbore. This reduces substantially water coning which allows more oil to be produced before high water production begins.

19 Claims, 5 Drawing Sheets

METHOD FOR REDUCED WATER CONING IN A HORIZONTAL WELL DURING HEAVY OIL PRODUCTION

CROSS-REFERENCE TO RELATED APPLICATIONS

This application is a continuation-in-part of application Ser. No. 419,875, filed Oct. 11, 1989, now abandoned. It is also a continuation-in-part of Ser. No. 07/625,289, filed on Dec. 10, 1990, also now abandoned.

FIELD OF THE INVENTION

This invention is directed to a method for the recovery of viscous hydrocarbonaceous fluids from a formation. More specifically, it is directed to the removal of said fluids from a formation containing heavy viscous hydrocarbons by the application of conduction heating through steam circulation within the horizontal wellbore in a manner to prevent water coning.

BACKGROUND OF THE INVENTION

The use of horizontal wells in oil reservoirs is currently of high interest within the oil industry. Horizontal wells allow more reservoir surface area to be contacted and thereby reduce inflow pressure gradients for reasonable oil production rates. Alternatively, for typical pressure gradients within the wellbore region, the productivity of a horizontal well is greater than that in a vertical well.

Several possible benefits of horizontal wells are currently being exploited in the Canadian tar sands. Reservoirs in Canada that may be categorized as immobile under reservoir conditions include the Cold Lake and Athabasca deposits. Horizontal wells are also being used to produce mobile viscous oil from a formation.

Current practices for producing the above immobile tar sands and mobile viscous oils include mining and steam stimulation by formation fracturing. However, mining is not practical below very shallow depths. Furthermore, steam stimulation by formation fracturing is not feasible in those reservoirs underlain by water aquifers. In general, fracturing in zones underlain by water aquifers or a bottom water zone results in large amounts of water production and non-uniform development of the steam zone. Large water influx is due to penetration of the fracture into the water aquifer and water coning around the wellbore.

Water coning is the phenomenon whereby water is drawn upwardly from the water-bearing portion into the oil-bearing portion about the well.

Steam stimulation below fracture pressure in a vertical well is not practical due to the very low injectivity of the formation to steam and the very small area of reservoir contact. Increased area of contact can be achieved by the use long horizontal wells (1,000 to 3,000 feet as compared to 30 to 100 feet for a vertical well). This increased area of contact allows more of the reservoir's area to be heated by steam injection. This results in more oil production due to increased volume of the heated zone. Injection of a large steam slug into a horizontal well underlain by a water aquifer may result in a fracture into the aquifer.

The length of horizontal wells permits smaller inflow pressure gradients during isothermal viscous oil production. However, the shape of the pressure profile around the wellbore remains logarithmic such that the largest pressure gradients occur in a near-wellbore region.

Hence, water coning, while reduced in horizontal wells compared to vertical wells is still quite a problem in viscous oil reservoirs, since a sharp pressure sink exists in the near-wellbore region.

Therefore, what is needed is a method to reduce water coning in a horizontal well so as to obtain an increased production of hydrocarbonaceous fluids from a heavy oil reservoir.

SUMMARY OF THE INVENTION

This invention is directed to a process for reducing water coning in a well when heating a reservoir at below fraction pressure in a very viscous hydrocarbonaceous fluid-containing formation, where at least one horizontal wellbore is utilized. A horizontal well is drilled into the formation. Steam is then circulated down an inner insulated tubing string to the far end of the horizontal portion of the wellbore. Steam then circulates back along the inside of a slotted liner completion. Steam does not penetrate through the slots in the slotted liner. Finally, steam passes up a return tubing string to the surface. This circulation of steam within the horizontal section provides a large temperature gradient from the wellbore to the formation. Hence, the horizontal section of the wellbore apparatus acts as a heat conductor, since no steam actually flows away from the wellbore into the formation. Circulation continues for a period greater than about two to five years.

Once sufficient reservoir heating is obtained, oil production is commenced by either artificial lift or natural drive lift aided by simultaneous steam circulation. Steam circulation is also continued during the artificial lift production phase. Viscous oil formation surrounding the wellbore is not heated by steam flow from the wellbore. Rather, heat flows away by conduction due to the large temperature difference between the wellbore and a virgin formation.

While circulating steam into and out of the wellbore, inflow pressure gradients are substantially reduced while simultaneously producing hydrocarbonaceous fluids to the surface. Simultaneous heating and producing of hydrocarbonaceous fluids from the reservoir results in a reduction of inflow pressure gradients in the near wellbore region which causes a smearing or spreading out of the pressure sink associated with the wellbore itself. Therefore, water coning, which results from a sharp pressure sink or high inflow pressure gradients, is substantially reduced.

This reduction in water coning allows for a substantial increase in hydrocarbonaceous fluids production from the viscous oil reservoir before water breaks through into the horizontal well. Additionally, when water breaks through, by maintaining simultaneous heating while producing hydrocarbonaceous fluids, the amount of water produced with the hydrocarbonaceous fluids is substantially reduced. This allows for increased volumes of hydrocarbonaceous fluids to be produced before reaching an uneconomically high water to oil ratio.

It is therefore an object of this invention to reduce water coning in a horizontal well when producing hydrocarbonaceous fluids therefrom.

It is another object of this invention to reduce water coning in a horizontal well penetrating a viscous hydrocarbonaceous fluid-containing reservoir by simultaneously heating said well while producing fluids therefrom.

It is yet another object of this invention to flatten or spread out a pressure sink in a near-wellbore region so as to reduce water coning in a heavy or viscous oil reservoir underlain by a bottom water zone or an aquifer.

It is yet another object of this invention to delay a high water to oil ratio when producing a viscous oil reservoir by reducing or delaying water coning.

It is still another object of this invention to simultaneously heat and produce a near-wellbore area of a horizontal well to reduce water coning in a viscous or heavy oil formation during primary oil production.

DESCRIPTION OF THE PREFERRED EMBODIMENT

Figure 1:
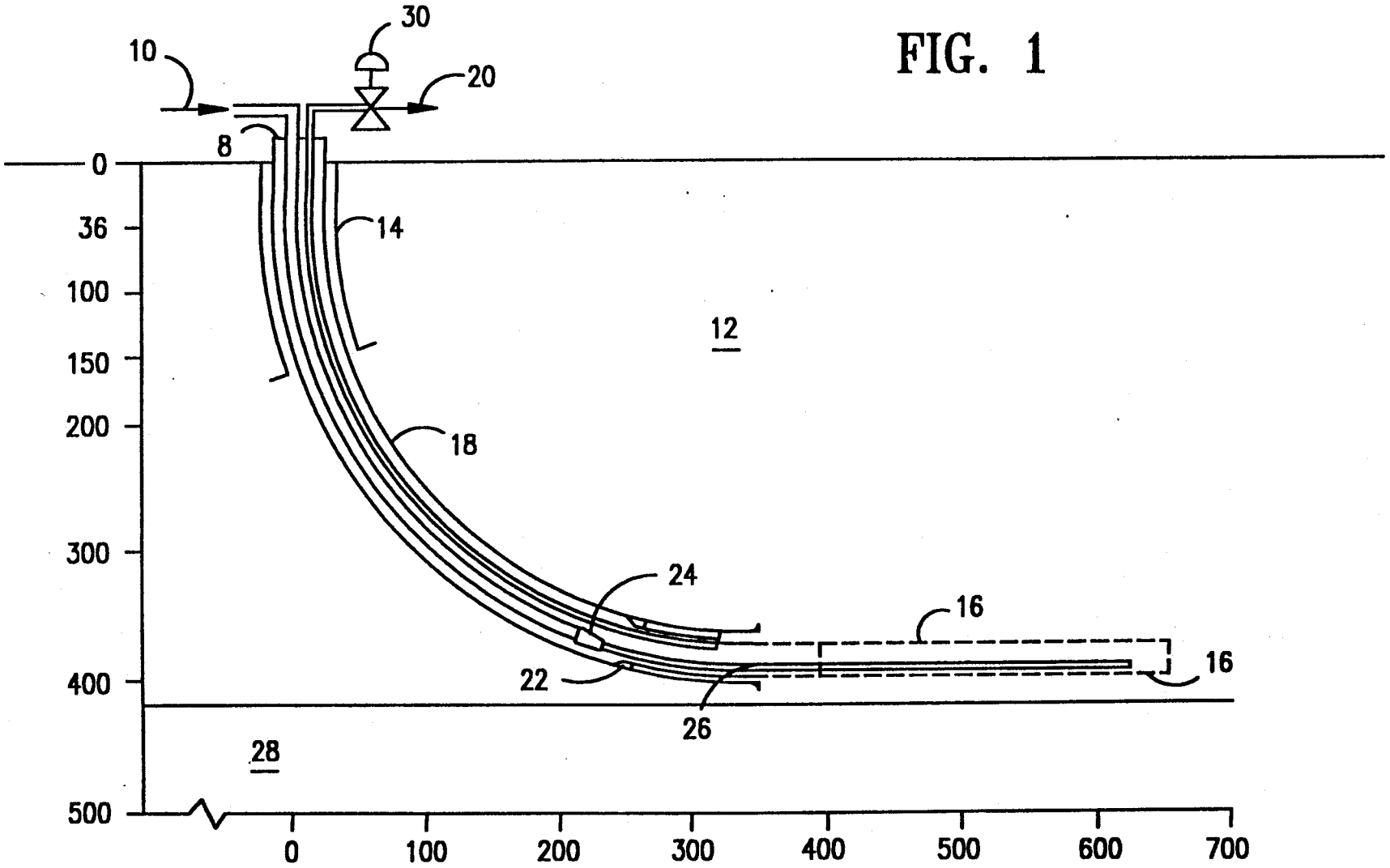
FIG. 1 is a schematic representation of the apparatus whereby steam circulation is made possible for conduction heating in a horizontal wellbore.
Figure 2:
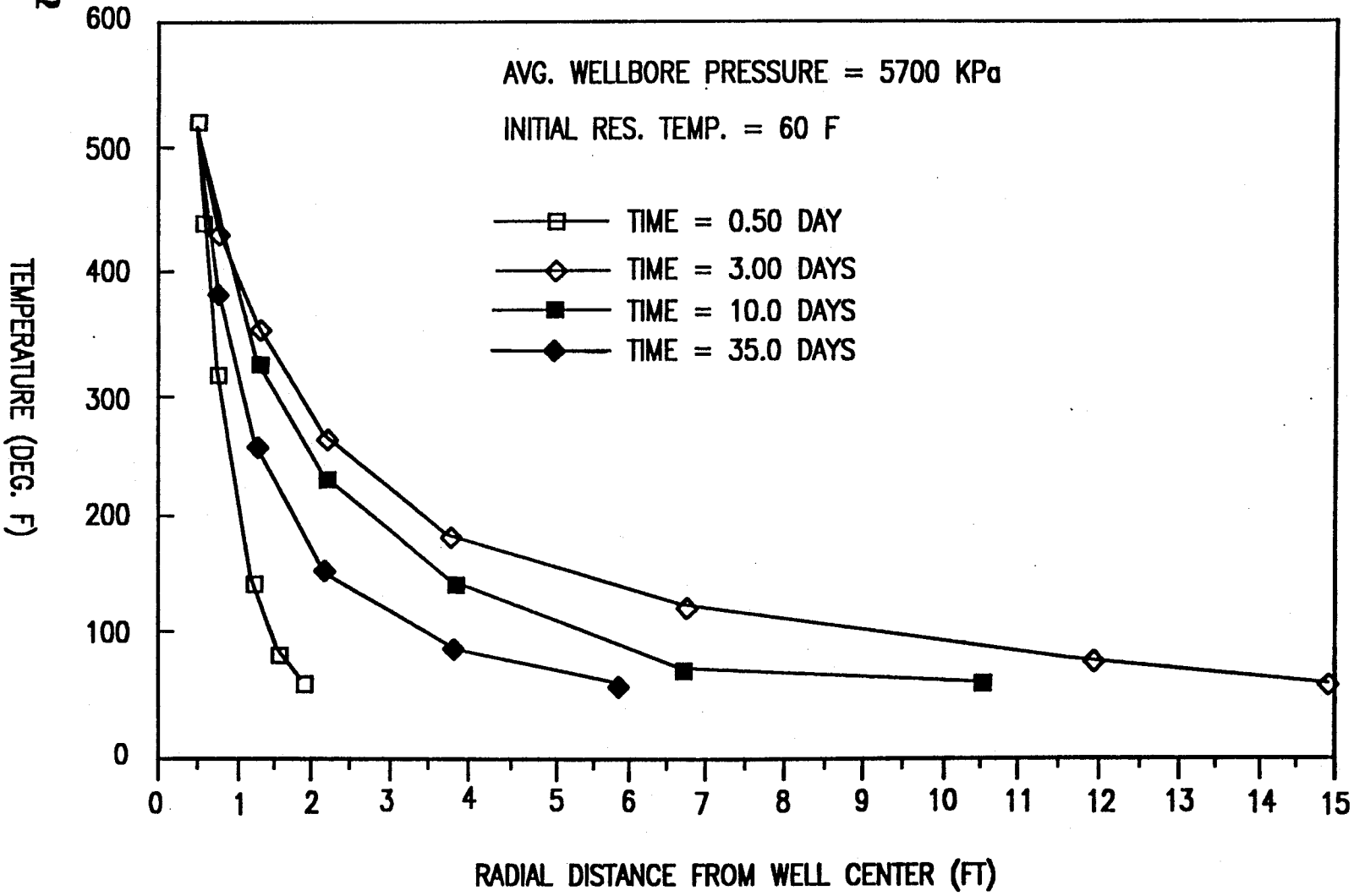
FIG. 2 is a graphical illustration depicting heat front (temperature) movement by conduction from the wellbore into the reservoir.

In the practice of this invention, referring to FIG. 1, steam is circulated down insulated injection tubing 10 which penetrates through surface casing 14 and intermediate casing 18 into oil bearing formation 12. Liner top 22 is fittingly affixed to intermediate casing 18. Liner top 22 is affixed to slotted liner 16 and penetrates oil bearing zone 12. Insulated injection tubing 10 contains cross over 24 at its distal end which is used to fluidly connect injection tubing tail joint 26 therewith. Insulated injection tubing 10 is confined within intermediate casing 18 so as to retain heat therein until steam can easily enter injection tubing tail joint 26 located within slotted liner 16 which extends horizontally within oil bearing formation 12 for a distance of at least about 200 to about 400 meters.

A substantially vertical portion of intermediate casing 18 penetrates formation 12 from about 300 to about 400 meters. Of course, as will be understood by those skilled in the art, these distances are formation dependent. Since injection tubing tail joint 26 extends substantially horizontally within slotted liner 16, any heat loss from tail joint 26 will dissipate into formation 12.

Steam travels down insulated injection tubing 10 and uninsulated injection tubing tail joint 26 where it exits into slotted liner 16. Because injection tubing 10 is insulated, heat loss into the vertical portion of the formation is minimized. Steam exits injection tubing tail joint at its far or distal end. Steam circulates within slotted liner 16 and flows into production tubing 20 where it exits formation 12 along with any hydrocarbonaceous fluids or water. Steam is circulated into formation 12 in the manner described for at least about 2 to about 5 years. As will be understood by those skilled in the art, the period of steam circulation is formation dependent. Steam circulation from the formation 12 is controlled by outlet surface valve 30.

While circulating steam into and from formation 12, steam pressure is maintained below the formation or reservoir fracture pressure. This steam pressure will generally be about 450 psi or less, depending, of course, on the formation pressure, which should be greater. Axial pressure exerted on production tubing 20 should be about 200 psi so as steam circulation to the surface. During steam initiation and circulation, an area of formation 12 penetrated by slotted liner 16 is heated by conduction only. The area of the formation from which hydrocarbonaceous fluids oil are derived can comprise heavy or viscous oils, asphalt, or asphaltic materials, for example. Heavy oils are defined as those oils having an API gravity of 19° . or less.

During the circulating and conduction heating period, oil production from production tubing 20 commences. Primary heavy oil production may be obtained by either artificial lift, e.g. by pumping means, or steam lift. If artificial lift is chosen, a production pump is placed on the wellbore assembly and the oil warmed by conduction is produced forcibly from the reservoir. During the artificial lift phase, steam circulation within the wellbore may either be terminated or continued. Oil production rates are anticipated to be higher, if steam circulation is maintained. Again, this points out the importance of the role of conductive heating in this process.

If steam lift is chosen, then the wellbore pressure is controlled by surface outlet valve 30. Wellbore pressure may be reduced to that below reservoir pressure while maintaining steam circulation. In this manner, oil flow from the reservoir 12 through the slotted liner 16 is initiated. Steam circulation provides heat to the reservoir by conduction alone during this process. Steam lift facilitates producing the oil bearing formation during steam circulation. Mechanical difficulties associated with artificial lift and steam circulation are avoided when steam lift is used.

Conduction heating is the main component of the process. Oil production is substantially a result of conductively heating the formation. Steam entry into the formation may take place but is not necessary for oil production.

This conduction heating process has several advantages over steam injection processes. Firstly, a pressure-up phase is not necessary. Secondly, no steam injection into the formation is necessary to initiate oil production. Thus, this process is particularly beneficial in water-sensitive formations, since substantial amounts of water are not produced in the formation. Thirdly, conduction-heated oil flows into the wellbore due to the natural drive of higher formation or reservoir pressure to a lower wellbore pressure. Because of these advantages, a novel, unique method of obtaining initial oil mobility without steam injection from the wellbore into the formation is provided for.

Figure 4:
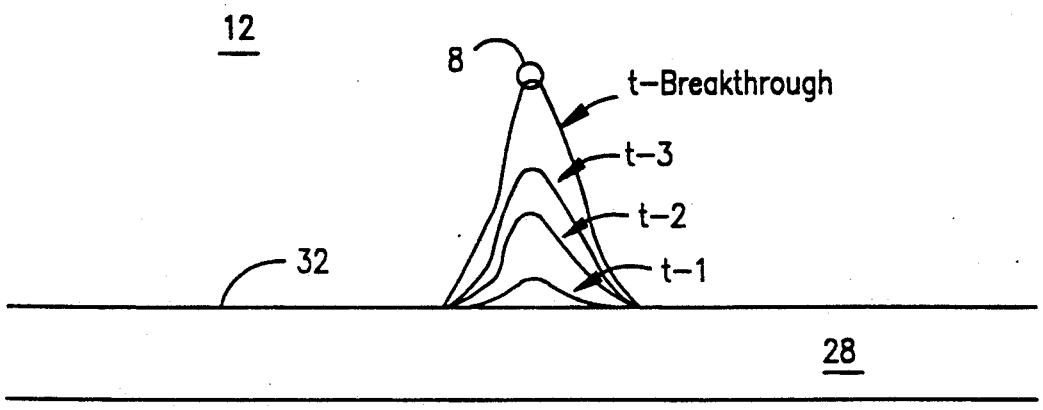
FIG. 4 illustrates schematically water coning at different times along a horizontal well during isothermal viscous oil production.

In addition to water-sensitive formations, this method is particularly beneficial when producing heavy oil from a formation containing an aquifer 28 or a bottom water zone below the area being produced as is shown in FIG. 1. This method is beneficial because pressure gradients near the horizontal wellbore are substantially less when heating and producing simultaneously viscous oil from the reservoir. When the near-wellbore area is unheated, the pressure gradients are substantially greater which causes water cones to form earlier in the production cycle. FIG. 4 shows water cone formation at different times near wellbore 8 in reservoir 12. Oil in the reservoir is separated from aquifer or bottom water zone 28 by water/oil interface 32.

Figure 3:
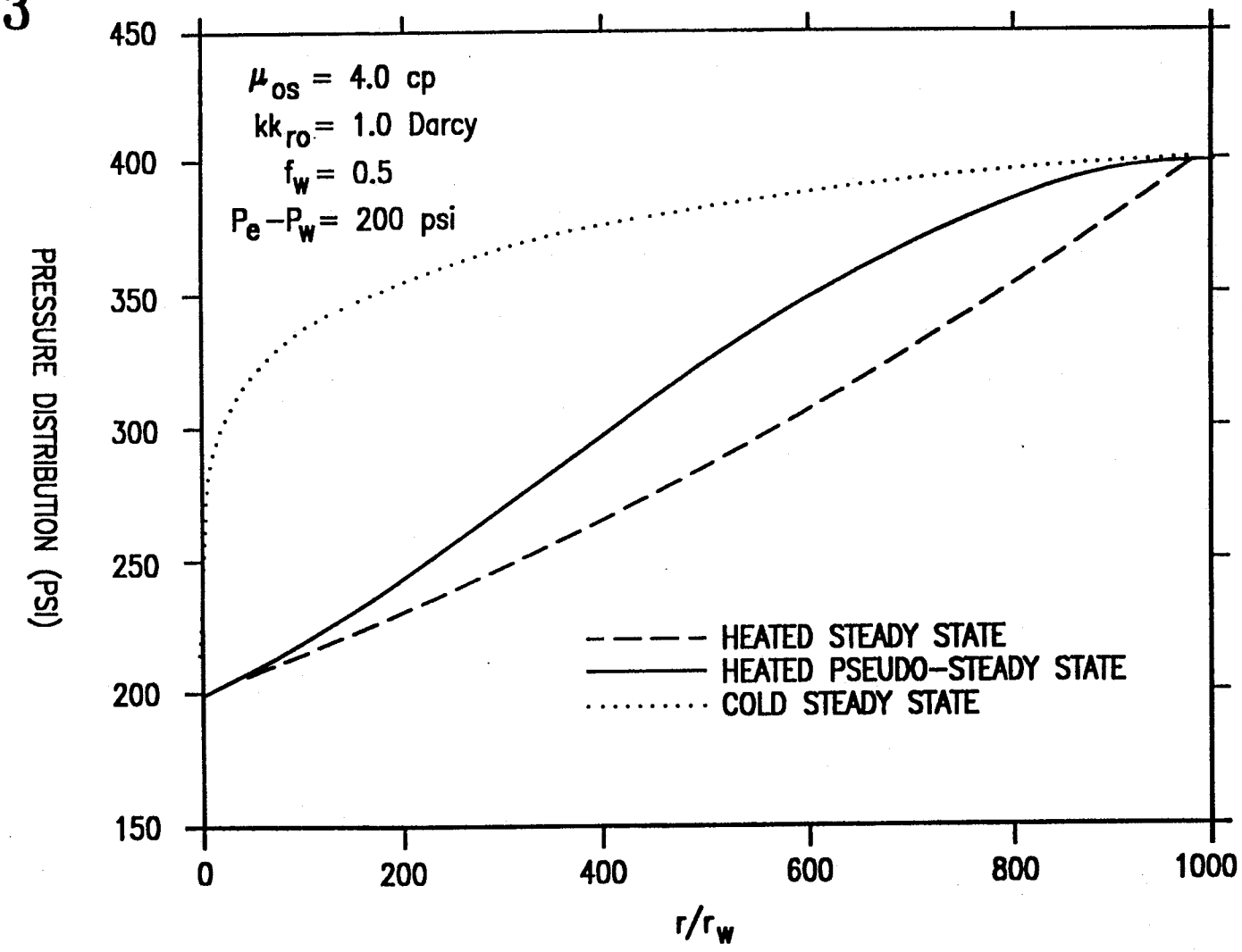
FIG. 3 represents graphically comparative calculated pressure distributions for a heated steady state, a heated pseudo-steady state, and a cold steady state.

Because the pressure gradient is substantially greater in the near-wellbore area when the horizontal well is cold, the water coning effect causes water to break through which leads to an increased water to oil ratio. This increased water ratio causes the production of oil from the formation to become uneconomical at an early stage of production. Calculated pressures around a horizontal wellbore are shown in FIG. 3. As shown there, a heated steady state during simultaneous oil production results in decreased pressure along the wellbore at substantially all radial distances from the wellbore. Calculations of a cold steady state show substantially increased pressures at radial distances up to about 800 feet from the wellbore.

FIG. 4 indicates the effect of a cold steady state upon water coning. As shown in this representation, the peaks and bases of the water cones formed with time are sharper and well-defined relative to wellbore 8 and oil/water interface 32. The bottom water zone or aquifer 28 lies below oil/water interface 32.

Figure 5:
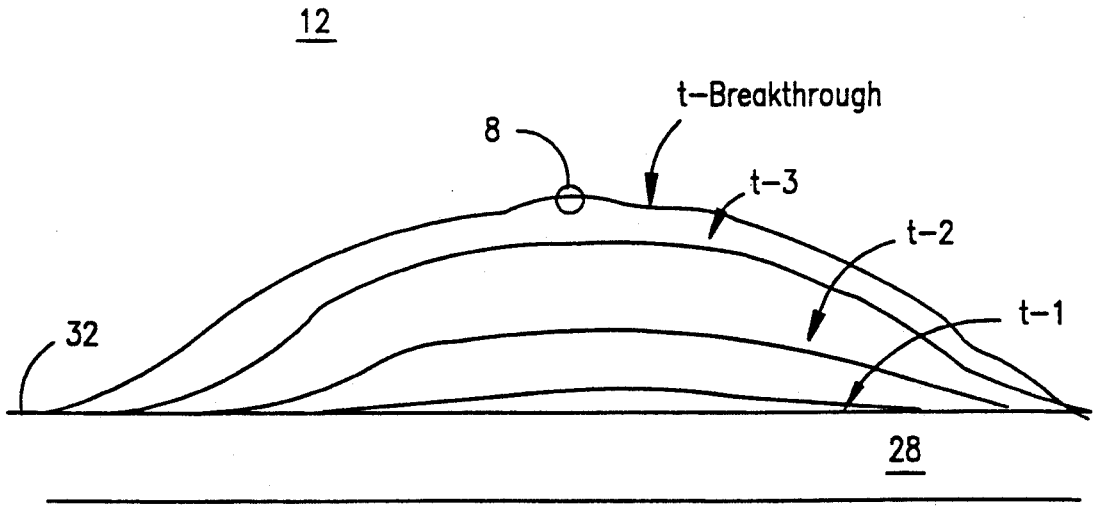
FIG. 5 depicts graphically initiation of broader cones at different times during simultaneous heating and producing in a viscous oil reservoir.

As horizontal wellbore 8 is heated, the water coning effect for a selected time interval (t−1) is substantially lessened. This is depicted in FIG. 5. Similar results are shown when wellbore 8 is heated for other selected time intervals, i.e. (t−2 through t-breakthrough). Since the water cones when heating wellbore 8 are substantially lessened and flatter than are possible in a cold steady state (FIG. 4), greater volumes of oil are produced from the formation with decreased volumes of water. Additionally, water breakthrough is delayed when heating wellbore 8 as shown in FIG. 5, while simultaneously producing oil from reservoir 12.

Figure 6:
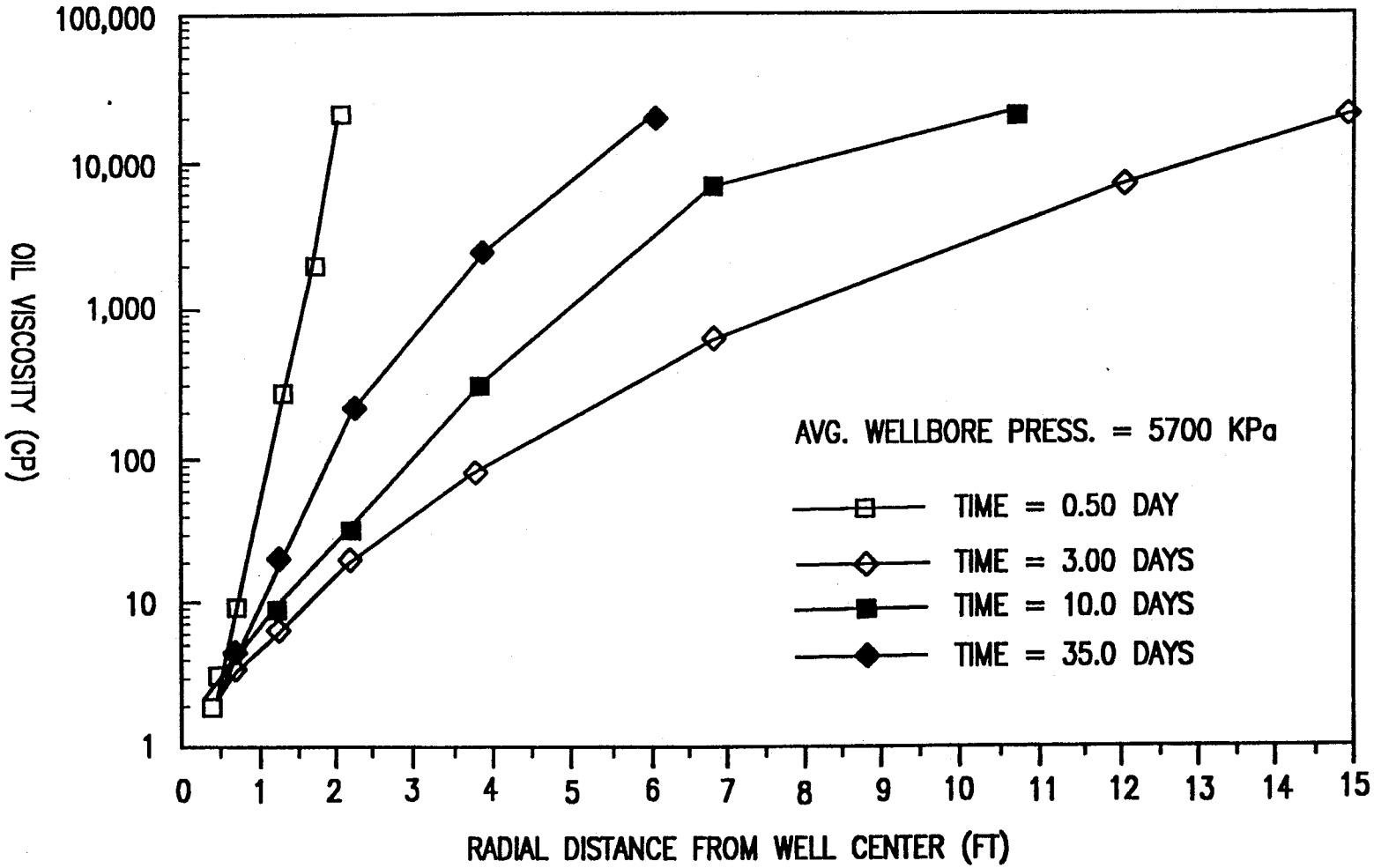
FIG. 6 demonstrates graphically oil viscosity distribution around a horizontal wellbore in space and time.

Heating causes a change in the viscosity of oil or hydrocarbonaceous fluids surrounding wellbore 8. Of course, as the reservoir is heated by steam circulation, oil viscosity is decreased at increased distances from the wellbore. This occurrence is graphically illustrated in FIG. 6. Heat also causes a flattening or spreading out of a pressure sink in the near-wellbore region which reduces water coning in a heavy oil viscous oil reservoir underlain by a bottom water zone. Thus, simultaneous heating and producing of a near-wellbore via a horizontal well reduces water coning in a viscous or heavy oil formation during primary oil production.

Many other variations and modifications of this invention as previously set forth may be made without departing from the spirit and scope of this invention as those skilled in the art understand. Such variations and modifications are considered part of this invention and within the purview and scope of the appended claims.

We claim:

1. A method to reduce water coning in a viscous oil formation during heavy oil production comprising:

a) circulating steam into a horizontal wellbore that penetrates a viscous oil containing formation or reservoir where said wellbore is positioned above an aquifer or bottom water zone in said formation which steam is at a pressure at or below the reservoir pressure and below the reservoir's fracture pressure so as to substantially avoid steam entry into the reservoir thereby conduction heating the formation;

b) allowing the steam to circulate in and out of said wellbore for a time sufficient to heat the reservoir by transient conduction to a temperature sufficient to mobilize hydrocarbonaceous fluids for a desired distance from the wellbore; and c) continuing circulation of steam in the wellbore thereby heating the formation and producing simultaneously oil of reduced viscosity to the surface thereby substantially reducing water coning from said aquifer or bottom water zone and increasing the production of hydrocarbonaceous fluids by substantially conduction heating only during heavy oil production from said reservoir while controlling the wellbore outlet pressure at or below the reservoir pressure.

2. The method as recited in claim 1 where steam is circulated into the wellbore and hydrocarbonaceous fluids are produced simultaneously to the surface for a period of from about two to about five years.

3. The method as recited in claim 1 where the steam circulation rates range from about 100 BBL/day to about 200 BBL/day (CWE) for about two to about five years.

4. The method as recited in claim 1 where the horizontal well is up to about 3,000 feet in length.

5. The method as recited in claim 1 where steam is circulated into said well past an insulated tubing string and is thereafter circulated around the string along the inside of a slotted liner well completion while traveling to the surface.

6. The method as recited in claim 1 step c) where steam is circulated into said well past an insulated tubing string and is circulated around the string along the inside of a slotted liner well completion while simultaneously producing hydrocarbonaceous fluids to the surface.

7. The method as recited in claim 1 where in step c) oil is produced by steam lift.

8. A horizontal heating method to reduce water coning in a viscous oil formations during heavy oil production comprising:

a) circulating steam via an insulated tubing string located in a horizontal wellbore that penetrates a viscous oil-containing formation or reservoir where said wellbore is positioned above an aquifer or bottom water zone in said formation in which the steam is at a pressure at or below the reservoir pressure and below the reservoir's fracture pressure so as to substantially avoid steam entry into the reservoir via a slotted liner well completion, thereby conduction heating the formation;

b) allowing the steam to circulate in and out of said wellbore for a time sufficient to heat the reservoir by transient conduction to a temperature sufficient to mobilize hydrocarbonaceous fluids for a desired distance from the wellbore; and c) continuing circulation of steam in the wellbore and producing simultaneously oil of reduced viscosity to the surface thereby substantially reducing water coning from said aquifer or bottom water zone and increasing the production of hydrocarbonaceous fluids by substantially conduction heating only during heavy oil production from said reservoir while controlling the wellbore outlet pressure at or below the reservoir pressure.

9. The method as recited in claim 8 where steam is circulated into the wellbore and hydrocarbonaceous fluids are produced simultaneously to the surface for a period of from about two to about five years.

10. The method as recited in claim 8 where the steam circulation rates range from about 100 BBL/day to about 200 BBL/day (CWE) for about two to about five years.

11. The method as recited in claim 8 where the horizontal well is up to about 3,000 feet in length.

12. The method as recited in claim 8 step c) where steam is circulated into said well past an insulated tubing string and is circulated around the string along the inside of a slotted liner well completion while simultaneously producing hydrocarbonaceous fluids to the surface.

13. The method as recited in claim 8 where in step c) oil is produced by steam lift.

14. A method for producing hydrocarbonaceous fluids from a water-sensitive formation during primary oil production comprising:

a) circulating steam into a horizontal wellbore that penetrates a viscous oil-containing formation or reservoir which steam is of a pressure at or below the reservoir pressure and below the reservoir's fracture pressure so as to substantially avoid a pressure-up phase and steam entry into the reservoir thereby conduction heating the formation;

b) allowing the steam to circulate in and out of said wellbore for a time sufficient to heat the reservoir by transient conduction to a temperature sufficient to mobilize hydrocarbonaceous fluids for a desired distance from the wellbore; and c) continuing circulation of steam in the wellbore thereby heating the formation and producing simultaneously oil of reduced viscosity to the surface thereby substantially reducing water production or accumulation and increasing the production of hydrocarbonaceous fluids by substantially conduction heating only during heavy oil production from said water-sensitive formation while controlling the wellbore outlet pressure at or below the reservoir pressure.

15. The method as recited in claim 14 where steam is circulated into the wellbore and hydrocarbonaceous fluids are produced simultaneously to the surface for a period of from about two to about five years.

16. The method as recited in claim 14 where the steam circulation rates range from about 100 BBL/day to about 200 BBL/day (CWE) for about two to about five years.

17. The method as recited in claim 14 where the horizontal well is up to about 3,000 feet in length.

18. The method as recited in claim 14 step c) where steam is circulated into said well past an insulated tubing string and is circulated around the string along the inside of a slotted liner well completion while simultaneously producing hydrocarbonaceous fluids to the surface.

19. The method as recited in claim 14 where in step c) oil is produced by steam lift.

* * * * *

UNITED STATES PATENT AND TRADEMARK OFFICE

CERTIFICATE OF CORRECTION

PATENT NO. : 5,297,627

DATED : March 29, 1994

INVENTOR(S) : J. M. Sanchez et al.

It is certified that error appears in the above-identified patent and that said Letters Patent is hereby corrected as shown below:

Col. 6, Claim 5, line 3, before "circulated" delete "thereafter"

Col. 6, Claim 8, Lines 1, 2 and 3 delete the first 3 lines and insert -- A method to reduce water coning in a viscous oil formation during heavy oil production comprising:--

Signed and Sealed this

Sixteenth Day of August, 1994

*Attest:*

*Attesting Officer*

BRUCE LEHMAN

*Commissioner of Patents and Trademarks*